US006199234B1

(12) United States Patent
Srour et al.

(10) Patent No.: US 6,199,234 B1
(45) Date of Patent: Mar. 13, 2001

(54) INFANT COMFORT MATTRESS

(76) Inventors: Mark Srour, 1446 E. 13th St., Brooklyn, NY (US) 11230; Joseph Srour, 1968 E. 12th St., Brooklyn, NY (US) 11229

( * ) Notice: Subject to any disclaimer, the term of this patent is extended or adjusted under 35 U.S.C. 154(b) by 0 days.

(21) Appl. No.: 09/362,597

(22) Filed: Jul. 28, 1999

(51) Int. Cl.[7] ..... A47C 27/15; A47C 27/20
(52) U.S. Cl. ..... 5/736; 5/716; 5/944; 5/740
(58) Field of Search ..... 5/736, 737, 738, 5/740, 716, 718, 727, 655.7, 655.9, 944

(56) References Cited

U.S. PATENT DOCUMENTS

| | | | | |
|---|---|---|---|---|
| 3,049,730 | * | 8/1962 | Wall et al. | 5/655.7 |
| 3,258,791 | * | 7/1966 | Kaplan | 5/736 |
| 4,064,578 | * | 12/1977 | Yamada | 5/944 X |
| 4,276,666 | * | 7/1981 | Yamada | 5/736 |
| 4,686,725 | | 8/1987 | Mitchell | 5/481 |
| 4,901,387 | | 2/1990 | Luke et al. | 5/464 |
| 4,972,535 | | 11/1990 | Goldman | 5/464 |
| 4,999,868 | * | 3/1991 | Kraft | 5/736 X |
| 5,136,740 | * | 8/1992 | Kraft | 5/736 X |
| 5,319,814 | * | 6/1994 | Dyer, Jr. | 5/736 X |
| 5,568,660 | * | 10/1996 | Raburn et al. | 5/737 X |
| 5,787,532 | | 8/1998 | Langer et al. | 5/717 |
| 6,023,803 | * | 2/2000 | Barman | 5/716 |

FOREIGN PATENT DOCUMENTS

| | | | | |
|---|---|---|---|---|
| 3831510 | * | 5/1989 | (DE) | 5/944 |
| 13967 | * | 8/1980 | (EP) | 5/740 |
| 2225229 | * | 5/1990 | (GB) | 5/944 |
| 36/2213706 | * | 9/1987 | (JP) | 5/736 |

* cited by examiner

*Primary Examiner*—Anthony Knight
*Assistant Examiner*—Robert G. Santos
(74) *Attorney, Agent, or Firm*—Marvin S. Arnoff

(57) ABSTRACT

A mattress structure that provides a relatively soft resilient surface under the weight of a recumbent infant or small child and also provides a degree of air flow, by means of bumps, depressions and ridges at the points of contact with the infant or child thereby providing a comfortable sleeping surface for the infant or small child. One version of the mattress structure is comprised of a combination of a base layer of relatively firm, resilient plastic foam having two major surfaces that are substantially flat and a relatively soft, convoluted foam cover layer, that covers at least one major surface of the base layer leaving the convoluted surface of the cover layer exposed. The combination of base layer and cover layer form a mattress filling that is contained in a mattress ticking. The mattress filling has an uncompressed height that is greater than the fully extended height of the mattress ticking so that the convoluted foam surface is in contact with a major inner surface of the ticking and is compressed by the ticking. The outer or sleeping surface of the mattress ticking having an inner surface that is in direct contact with the compressed convoluted foam surface exhibits a multiplicity of bumps, depressions and ridges.

20 Claims, 2 Drawing Sheets

INFANT COMFORT MATTRESS

BACKGROUND OF THE INVENTION

This invention deals with a mattress structure designed to provide a comfortable sleeping surface for infants and young children.

The ability of an infant or young child to sleep comfortably and for relatively long periods is of importance to its own health and well being as well as to that of its care givers. The mattress on which the infant sleeps in a bed or crib may contribute to the infants comfort and thus, to some extent, promote sleep. Most conventional infant mattresses, are generally either innerspring or foam block structures contained within an outer shell or ticking that is generally made of a liquid resistant material such as a vinyl fabric. Such conventional mattress structures, which employ relatively stiff inner springs and high density foams, although resilient when slept on by adults and large children provide an essentially flat surface that is relatively hard and unyielding under the weight of a recumbent infant or small child.

There is a need for a mattress structure that is more suitable to the comfort of the infant or small child. Such a mattress should provide a degree of resilience and bounce, yet yield to some degree under the weight of a recumbent infant or small child to provide a sensation of softness. At the same time the mattress should not be so soft and yielding as to create a suffocation hazard. In addition, it is desirable that the mattress surface provide a degree of air flow at the points of contact with the recumbent infant or child in order to allow evaporation of perspiration. Such a mattress should also be economical to make and easily manufactured.

BRIEF DESCRIPTION OF THE INVENTION

The present invention is directed to meeting the foregoing needs by providing a mattress comprised of a combination of a base layer comprised of a block of relatively firm plastic foam having two major surfaces that are substantially flat and a cover layer, that covers at least one major surface of the base layer, comprised of relatively soft, resilient plastic foam having at least one convoluted surface, with the combination of base layer and cover layer contained within a mattress ticking so that the convoluted foam surface is in contact with a major inner surface of the ticking and is compressed by the ticking. The outer or sleeping surface of the mattress ticking having an inner surface that is in direct contact with the compressed convoluted foam surface exhibits a multiplicity of bumps, depressions and ridges. The mattress of the present invention provides a relatively soft resilient surface under the weight of a recumbent infant or small child and also provides a degree of air flow, by means of the bumps, depressions and ridges at the points of contact with the infant or child. The mattress of the present invention thereby provides a comfortable sleeping surface for the infant or small child.

DESCRIPTION OF THE PREFERRED EMBODIMENTS

Figure 1:
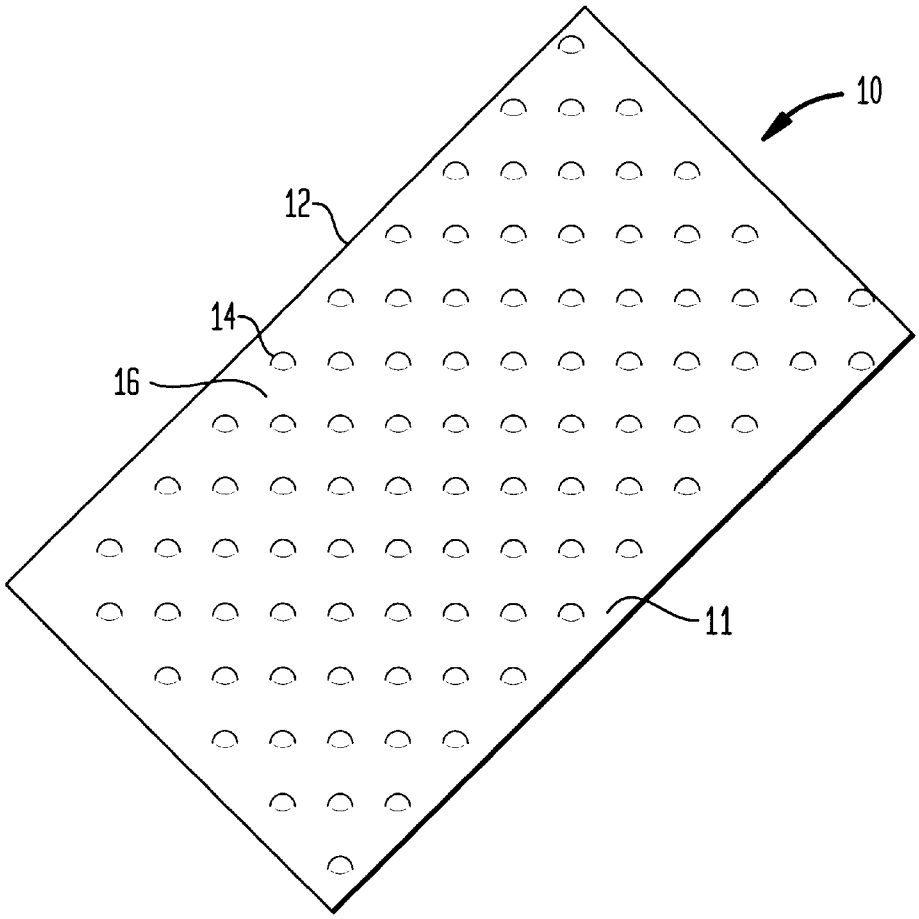
FIG. 1 is a perspective view depicting the sleeping surface of an embodiment of a mattress of the present invention showing bumps, depressions and ridges in the ticking due to compression of the convoluted surface under the ticking.

FIG. 1 is a perspective view depicting the sleeping surface 11 of a mattress 10 of the present invention in which the ticking 12, exhibits rises or bumps 14, and indentations or depressions 16 forming a system of ridges and grooves or depressions which crisscross the ticking surface.

Figure 2:
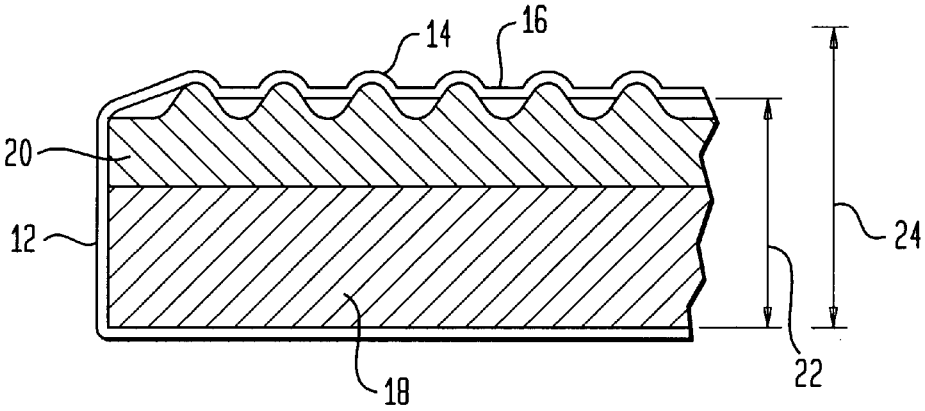
FIG. 2 is a cross-sectional view of a version of the mattress structure of the present invention.

FIG. 2 is a cross-sectional view of a version of the mattress structure 10 of the present invention. Mattress structure 10 is comprised of ticking 12 which contains base layer 18 and cover layer 20 under compression. Ticking 12 may be made of any material commonly used in the art. Typically, ticking 12 is a vinyl coated fabric but it may be of any flexible material or fabric known in the art that provides a suitable sleeping surface for an infant or small child.

The fabric comprising ticking 12 and any seams used in the construction of ticking 12 must be of sufficient strength to retain the combination of base layer 18 and cover layer 20 under compression without rupture in use. Generally the ticking 12 is provided with vent holes in its sides to allow for a degree of air circulation in the mattress structure. However, with ticking fabrics having sufficient porosity to allow air circulation such vent holes may be unnecessary.

Base layer 18 is comprised of a relatively firm polymeric foam. Typically, base layer 18 is comprised of polyurethane foam, preferably a polyether polyurethane, but any other type of foamed material known in the art having sufficient resiliency may also be used. Applicable test methods for the foams comprising the mattress structure of the present invention are found in ANSI/ASTM-D-3574-95 which is herein incorporated by reference. Generally, the foam comprising base layer 18 has an apparent density of about 1.1 to about 1.6 lbs/ft$^3$ with a density in the range of about 1.25 to about 1.45 lbs/ft$^3$ preferred and an indentation force deflection (IFD) of about 60 to about 80 lb/50 inch$^2$ at 25% deflection with an IFD of about 70 lb/50 inch$^2$ preferred. Base layer 18 generally has a tensile strength sufficient to withstand manufacturing operations without significant damage. The tensile strength of base layer 18 is generally about 5 to about 15 psi with a tensile strength of about 10 psi preferred. The ultimate elongation of base layer 18 is at least about 35% with about 50% preferred. The minimum tear strength of base layer 18 is generally sufficient to withstand manufacturing operations without significant damage. Generally, base layer 18 should have a tear strength of at least about 0.5 lb/inch with at least about 1 lb/inch preferred. The compression set of base layer 18 is about 5% to about 15% maximum loss with about 10% maximum loss preferred under standard test conditions used in the art such as those reported in General Foam Corporation (Paramus, N.J.) Product Information and Technical Data for Polyether Foam Grade 13060XXX which is herein incorporated by reference.

Cover layer 20 is comprised of a relatively soft polymeric foam. Typically, cover layer 20 is comprised of convoluted polyurethane foam, preferably a polyether polyurethane, but any other type of convoluted foamed material known in the art having sufficient softness and resiliency may also be used. The term "convoluted" with regard to cover layer or pad 20 is herein defined as a surface generally comprising alternating rows of peaks and valleys, in checkerboard fashion. Convoluted foams and their manufacture are described in U.S. Pat. No. 5,430,901 which is herein incorporated by reference. The convoluted foam layer has two major surfaces preferably with projections from one major surface that form the peaks and valleys, with the other major surface being flat. However, a convoluted foam cover layer having projections from both major surfaces may also be used.

Generally, the foam comprising cover layer 20 has an apparent density of about 0.68 to about 1.05 Ibs/ft$^3$ with a density in the range of about 0.77 to about 0.97 lbs/ft$^3$ preferred and an indentation force deflection (IFD) of about 23 to about 40 lb/50 inch$^2$ at 25% deflection with an IFD of about 28 to about 34 lb/50 inch$^2$ preferred. Cover layer 20 generally has a tensile strength sufficient to withstand manufacturing operations without significant damage. The tensile strength of cover layer 20 is generally about 5 to about 15 psi with a tensile strength of about 10 psi preferred. The ultimate elongation oi cover layer 20 is at least about 75% with about 100% preferred. The minimum tear strength of cover layer 20 is generally sufficient to withstand manufacturing operations without significant damage. Generally, cover layer 20 should have a tear strength of at least about 0.5 lb/inch with at least about 1 lb/inch preferred. The compression set of cover layer 18 is about 5 to about 15% maximum loss with about 10% maximum loss preferred under standard test conditions used in the art such as those reported in General Foam Corporation (Paramus, N.J.) Product Information and Technical Data for Polyether Foam Grade 35000XXX which is herein incorporated by reference.

Referring to FIG. 2, it is generally preferred that both the cover layer and the base layer, which together have an uncompressed height 24, that is substantially greater than ticking height 22, be sufficiently compressible to permit condensation or compression of the foam layers to fit within ticking 12 having ticking height 22. However, some versions of the mattress structure of the present invention may be formed by using either a base layer or a cover layer that is relatively compressible in combination with a base layer or a cover layer that is far less compressible providing that the combination of base layer and cover layer can be condensed sufficiently to fit within ticking 12 having ticking height 22. Typically the combination of foam layers 18 and 20 having height 24 is compressed by covering with plastic sheeting and evacuating the space enclosed by the plastic sheeting by means of a vacuum board or other means known in the art so that the plastic sheeting compresses the foam layers to extent sufficient to allow insertion of the layers into ticking 12 having ticking height 22. Other means such as a Steel compression machine or yet other means known in the art may be used to compress layers 18 and 20. Generally, the uncompressed height 24 of foam layers 18 and 20 should exceed ticking height 22 by about 5% to about 50%, with about 15% to about 40% preferred and about 20% to about 35% most preferred. To produce the dimpled sleeping surface of the present invention it is preferred that the projections of the convoluted foam layer project about 0.5 inch to about 2.5 inches from the base of the foam with about 0.75 inch to about 1.25 inch preferred.

Figure 3:
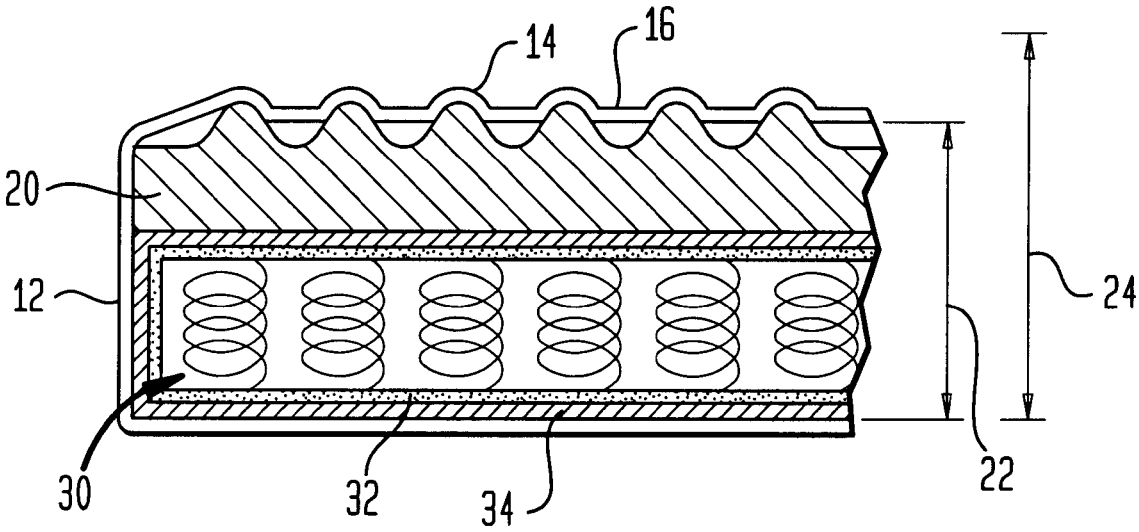
FIG. 3 is a schematic depiction of a version of the mattress structure of the present invention using an inner spring structure.

The mattress structure of the present invention provides a comfortable sleeping surface for an infant or small child that comprises a firm, resilient, compressible base layer having two major surfaces that are substantially flat, with the base layer having an uncompressed height $h_B$ between the two major surfaces, and a soft, resilient compressible polymeric foam cover layer. The cover layer has a first and a second major surface, with the first major surface being substantially flat and the second major surface being substantially covered with peaks of approximately uniform height, with the peaks having tops, and valleys of approximately uniform depth, with the peaks and the valleys alternating within rows in checkerboard fashion. Such structures are known in the art as convoluted foam or convoluted pads. The compressible cover layer has an uncompressed height, $h_C$, with the height $h_C$ being the vertical distance between the first major surface and the tops of the peaks of the second major surface. The first surface of the cover layer covers one of the two major surfaces of the base layer to form a mattress filling comprising the base layer and the cover layer, with the mattress filling having the peaks of the cover layer exposed. The uncompressed height of the mattress filling is equal to the sum of the uncompressed heights of its components, $h_B$ and $h_C$ schematically depicted as 24 in FIGS. 2 and 3. The mattress structure of the present invention further comprises a mattress ticking that contains the mattress filling, with the mattress ticking having two major sides and with the two major sides of the mattress ticking separated by a fully extended height, $h_T$, schematically depicted as 22 in FIGS. 2 and 3, with $h_T$ being substantially less than the sum of $h_B$ and $h_C$, as schematically depicted in FIGS. 2 and 3, so that the mattress ticking is in compressive contact with the mattress filling that is contained within the ticking. One of the two major sides of the mattress ticking compressively contacts the second of the two major surfaces of the base layer comprising the mattress filling and the second of the two major sides of the mattress ticking compressively contacts the peaks of the cover layer comprising the mattress filling so that the peaks of the cover layer press against the second of the two major sides of the mattress ticking and create a pattern of rises, 14, and depressions, 16, on the second of the two major sides of the mattress ticking, with the pattern of rises and depressions on the second of the two major sides of the mattress ticking providing a comfortable sleeping surface for an infant or small child.

The following example illustrates a method for the production of the infant comfort mattress of the present invention. As will be apparent to those skilled in the art, the present invention may be made by other means known in the art. Therefore, the example is illustrative and is not intended to limit the present invention in any way.

A crib mattress having dimensions commonly used in the art was prepared from a vented vinyl fabric ticking having a length of about 51.75 inches, a width of about 27.5 inches and a maximum height of about 5 inches having one short side open, a block of firm polyurethane foam having a density of about 1.3 lbs/ft$^3$, a length of about 51.75 inches, a width of about 27.5 inches and a height of about 4.75 inches to serve as the base layer and a sheet of convoluted polyurethane foam having a density of about 0.8 lbs/ft$^3$, a length of about 51.75 inches, a width of about 27.5 inches and an overall height of about 1.5 inches, with the projections from the foam surface having about a 1 inch height, to serve as the cover layer. The cover layer was superimposed on the base layer with the convoluted side exposed, and the foam layers were covered with a sheet of plastic and placed on a vacuum table to condense the foam layers and enable them to fit into the undersized ticking. The open side of the ticking was then sealed by sewing the seams.

In another version of the mattress structure of the present invention the dimpled sleeping surface, schematically depicted in FIG. 1, may be generated on both sides of the mattress by placing sheets of convoluted foam on both major surfaces of the base layer 18. In this instance, the thickness of the base layer may optionally be reduced by an appropriate amount to accommodate the thickness of the second sheet of convoluted foam or a greater ticking height may be used. The height or thickness of the convoluted layers or convoluted pads, including the height of the peaks may be the same or different for each layer.

In yet another version of the mattress structure of the present invention, as schematically illustrated in FIG. 3, foam base layer 18 is replaced by a mattress innerspring assembly comprising interconnected arrays of coil springs 30 which provides a firm and resilient base under convoluted foam layer 20. Such innerspring structures formed from an array of coil springs are commonly known and used in the art and are discussed, for example, in U.S. Pat. No. 5,787,532 which is incorporated herein by reference. The basic innerspring structure may optionally be covered with an insulating pad 32 which is preferably of foam fiber construction although other suitable materials known in the art may be used. The insulating pad 32 may optionally be covered with foam cushioning pad 34 which is preferably an extra firm grade of polyurethane foam although other suitable materials known in the art may be used. As schematically depicted in FIG. 3 the uncompressed height 24 of the innerspring structure with or without any optional components is greater than the ticking height dimension 22. The compressed or condensed mattress components sealed within ticking 12 having ticking height 22 produce a sleeping surface in which the ticking 12, exhibits rises 14, and indentations 16 forming a system of ridges and grooves or depressions which crisscross the ticking surface.

The dimpled sleeping surface of the mattress of the present invention has the advantage of conferring a pleasant hand and a comforting, soothing sensation for a sleeping or resting infant or small child generally up to about the age of three years or about 50 pounds in weight but it is especially effective from the infancy period up to about one year of age when the weight of the child is generally under about 25 pounds. A further advantage of the gentle rises and depressions of the dimpled sleeping surface of the present invention is that they tend to provide a gentle surface for contact with an infant's delicate skin. A still further advantage is a gentle bouncing sensation that is produced when an infant moves on the dimpled sleeping surface that is comforting to an infant or small child.

The version of the mattress structure of the present invention made from a firm base layer and a convoluted foam cover layer has the additional advantage of providing two different sleeping surfaces. The dimpled sleeping surface produced by the compressed convoluted foam is generally the most comfortable for infants and children up to about three years of age. When the mattress is turned upside-down, the firmer surface produced by the base foam 18 or the inner- spring structure 30 may be used as a second sleeping surface that is suitable for children older than three years of age who are also generally too heavy to benefit from the more compressible dimpled mattress surface. The second outer or sleeping surface of the mattress ticking having an inner surface that is in direct contact with the compressed base layer is generally substantially flat although in some cases it may have a gentle continuous curvature produced by the compressed base layer of the mattress filling.

Although the present invention has been described in considerable detail with reference to certain preferred versions thereof, other versions are possible. Therefore, the spirit and scope of the appended claims should not be limited to the description of the preferred versions contained herein.

what is claimed is:

1. A mattress structure to provide a comfortable sleeping surface for an infant or small child comprising:

a firm, resilient, compressible base layer having two major surfaces that are substantially flat, with the base layer having an uncompressed height $h_B$ between the two major surfaces, and a soft, resilient compressible polymeric foam cover layer, with the cover layer having a first and a second major surface, with the first major surface being substantially flat and the second major surface being substantially covered with peaks of approximately uniform height, with the peaks having tops, and valleys of approximately uniform depth, with the peaks and the valleys alternating within rows in checkerboard fashion, and with the cover layer having an uncompressed height, $h_C$, with the height $h_C$ being the vertical distance between the first major surface and the tops of the peaks of the second major surface, and with the first surface of the cover layer covering one of the two major surfaces of the base layer to form a mattress filling comprising the base layer and the cover layer, with the mattress filling having the peaks of the cover layer exposed, and with the uncompressed height of the mattress filling equal to the sum of $h_B$ and $h_C$, and a mattress ticking that contains and compresses the mattress filling, with the mattress ticking having two major sides and with the two major sides of the mattress ticking separated by a fully extended height, $h_T$, and the sum of $h_B$ and $h_C$ exceeding $h_T$ by about 5% to about 50%, so that the mattress ticking is in compressive contact with the mattress filling that is contained within the ticking, and with one of the two major sides of the mattress ticking compressively contacting the second of the two major surfaces of the base layer comprising the mattress filling and the second of the two major sides of the mattress ticking compressively contacting the peaks of the cover layer comprising the mattress filling so that the peaks of the cover layer press against the second of the two major sides of the mattress ticking and create a pattern of rises and depressions on the second of the two major sides of the mattress ticking, with the pattern of rises and depressions on the second of the two major sides of the mattress ticking providing the comfortable sleeping surface.

2. The mattress structure of claim 1 in which the sum of $h_B$ and $h_C$ exceeds $h_T$ by about 20% to about 45%.

3. The mattress structure of claim 2 in which the base layer comprises a high density polymeric foam.

4. The mattress structure of claim 3 in which the base layer comprises a polyurethane foam having a density of about 1.1 to about 1.6 lbs/ft$^3$.

5. The mattress structure of claim 4 in which the cover layer comprises a polyurethane foam having a density of about 0.68 lbs/ft$^3$ to about 1.05 lbs/ft$^3$.

6. The mattress structure of claim 1 in which the base layer comprises a mattress innerspring assembly comprising interconnected arrays of coil springs disposed between the two major surfaces of the base layer.

7. The mattress structure of claim 6 in which the cover layer comprises a polyurethane foam having a density of about 0.68 lbs/ft$^3$ to about 1.05 lbs/ft$^3$.

8. The mattress structure of claim 5 in which the ticking is comprised of a vinyl coated fabric and the ticking is vented.

9. The mattress structure of claim 7 in which the ticking is comprised of a vinyl coated fabric and the ticking is vented.

10. The mattress structure of claim 1 comprising a cover layer having both major surfaces substantially covered with peaks and in which the uncompressed height of the mattress filling is equal to the sum of $h_B$ and the uncompressed height of the cover layer, and the compressed height of the mattress filling exceeds $h_T$ by about 5% to about 50% and with a major surface of the cover layer that is substantially covered with peaks covering one of the two major surfaces of the base layer.

11. A mattress structure to provide a comfortable sleeping surface for an infant or small child made by a method comprising the steps of:

providing a firm, resilient, compressible base layer having two major surfaces that are substantially flat, with the base layer having an uncompressed height $h_B$ between the two major surfaces, and providing a soft, resilient compressible polymeric foam cover layer, with the cover layer having a first and a second major surface, with the first major surface being substantially flat and the second major surface being substantially covered with peaks of approximately uniform height, with the peaks having tops, and valleys of approximately uniform depth, with the peaks and the valleys alternating within rows in checkerboard fashion, and with the cover layer having an uncompressed height, $h_C$, with the height $h_C$ being the vertical distance between the first major surface and the tops of the peaks of the second major surface, and covering one of the two major surfaces of the base layer with the first major surface of the cover layer to form a mattress filling comprising the base layer and the cover layer, with the mattress filling having the peaks of the cover layer exposed, and with the uncompressed height of the mattress filling equal to the sum of $h_B$ and $h_C$, and providing a mattress ticking that contains and compresses the mattress filling, with the mattress ticking having two major sides and with the two major sides of the mattress ticking separated by a fully extended height, $h_T$, and with the sum of $h_B$ and $h_C$ exceeding $h_T$ by about 5% to about 50%, and condensing the mattress filling so that the condensed height of the mattress filling is less than $h_T$, and inserting the condensed mattress filling into the ticking and sealing the ticking, so that the mattress ticking is in compressive contact with the resilient mattress filling that is contained within the ticking, and with one of the two major sides of the mattress ticking compressively contacting the second of the two major surfaces of the base layer comprising the mattress filling and the second of the two major sides of the mattress ticking compressively contacting the peaks of the cover layer comprising the mattress filling so that the peaks of the cover layer press against the second of the two major sides of the mattress ticking and create a pattern of rises and depressions on the second of the two major sides of the mattress ticking, with the pattern of rises and depressions on the second of the two major sides of the mattress ticking providing the comfortable sleeping surface.

12. The mattress structure of claim 11 in which the sum of $h_B$ and $h_C$ exceeds $h_T$ by about 20% to about 45%.

13. The mattress structure of claim 12 in which the base layer comprises a high density polymeric foam.

14. The mattress structure of claim 13 in which the base layer comprises a polyurethane foam having a density of about 1.1 to about 1.6 lbs/ft$^3$.

15. The mattress structure of claim 14 in which the cover layer comprises a polyurethane foam having a density of about 0.68 lbs/ft$^3$ to about 1.05 lbs/ft$^3$.

16. The mattress structure of claim 15 in which the ticking is comprised of a vinyl coated fabric and the ticking is vented.

17. The mattress structure of claim 11 in which the base layer comprises a mattress innerspring assembly comprising interconnected arrays of coil springs disposed between the two major surfaces of the base layer.

18. The mattress structure of claim 17 in which the cover layer comprises a polyurethane foam having a density of about 0.68 lbs/ft$^3$ to about 1.05 lbs/ft$^3$.

19. The mattress structure of claim 18 in which the ticking is comprised of a vinyl coated fabric and the ticking is vented.

20. The mattress structure of claim 11 comprising a cover layer having both major surfaces substantially covered with peaks and in which the uncompressed height of the mattress filling is equal to the sum of $h_B$ and the uncompressed height of the cover layer, and the uncompressed height of the mattres filling exceeds $h_T$ by about 5% to about 50% and with a major surface of the cover layer that is substantially covered with peaks covering one of the two major surfaces of the base layer.

* * * * *